United States Patent [19]

Herst et al.

[11] Patent Number: 4,706,170

[45] Date of Patent: Nov. 10, 1987

[54] LIGHTING FIXTURE HANGER UNIT FOR A MODULAR LIGHTING SYSTEM

[75] Inventors: Douglas J. Herst, Ross; Henry H. Iwahashi, El Cerrito, both of Calif.

[73] Assignee: Peerless Lighting Corporation, Berkeley, Calif.

[21] Appl. No.: 719,361

[22] Filed: Apr. 3, 1985

[51] Int. Cl.[4] ..... F21S 3/00

[52] U.S. Cl. ..... 362/217; 362/225; 362/226; 362/249; 362/396

[58] Field of Search ..... 362/95, 217, 225, 226, 362/249, 374, 396, 404, 433, 436, 147, 438; 339/50 R–57, 69, 73; 403/344, 309, 313; 24/643, 645, 647

[56] References Cited

U.S. PATENT DOCUMENTS 2,400,381 5/1946 Young ..... 339/50 C 4,420,798 12/1983 Herst et al. .

4,428,697 1/1984 Roland ..... 403/313

*Primary Examiner*—Samuel Scott

*Assistant Examiner*—Noah Kamen

*Attorney, Agent, or Firm*—Donald L. Beeson

[57] ABSTRACT

An hanger unit for linear lighting fixture modules includes a housing with at least one, and typically two or a multiple of fixture connection ports, from which a linear fixture having a standardized male end connector can be releasably engaged by means of a quick release operation. Each fixture port of the hanger unit is provided with a circumferential flange structure which is, in part, formed by a bottom hinge bracket adapted to pivot downwardly to receive the fixture's corresponding male end connector and to releasibly lock over the male end connector when closed. A removable bottom cover piece covers the bottom hinge brackets and provides a completed hanger structure housing that compliments the appearance of the connected fixture modules. By using a number of hanger units made in accordance with the invention an articulated lighting fixture array can easily be installed and later modified or added to by adding or substracting fixtures to the connection ports of the hanger units.

14 Claims, 9 Drawing Figures

LIGHTING FIXTURE HANGER UNIT FOR A MODULAR LIGHTING SYSTEM

BACKGROUND OF THE INVENTION

The present invention relates generally to hardware for mounting or suspending lighting fixtures to walls or from overhead ceilings, and more particularly to fixture joiner hangers and end hangers that are used for hanging lighting fixture elements or modules either singularly or in an array to produce a complete lighting system. The invention specifically pertains to so-called "linear" lighting systems comprised of stand alone or articulated elongated fixture elements or modules, modules that are provided in uniform crossectional shapes, typically round, square or rectangular, and that can be fabricated of extruded materials. Such fixtures can use fluorescent, incandescent or HID light sources and can be configured into lighting systems for commercial, institutional and office environments. Linear lighting systems may, within the same system, be comprised of indirect lighting or direct lighting fixture elements or modules of various standard lengths or a combination of both indirect and direct fixtures modules.

Presently, installation of linear lighting systems is a time-consuming and relatively costly, labor intensive process involving installation of permanent hanging hardware throughout a building from which oftentimes hundreds of feet of linear fixture elements are permanently secured by screw attachments or the like. Typical hanger hardware include the use of solid stems, or aircraft cable for suspended fixtures, or mounting brackets for surface mounted fixtures. Suspended and wall mounted rotatable fixture mountings have also been devised wherein a linear fixture element is suspended between two wall or ceiling mounted end hangers that are bolted to the end of the fixture. The fixture hangers of whatever type are placed at spaced intervals and mechanically attached to the room ceiling or wall surfaces, for example, eyebolts in an overhead ceiling are normally used in the case of aircraft cable suspensions. Where the fixtures are surface mounted they are typically bolted to ceiling or wall mounting brackets. In all the foregoing examples of hanger hardward, the housing of the fixture modules used in the installation must be drilled and/or provided with hardware that will accomodate the specified hangers. This means that the manufacturer must make a large variety of basic module design variations available to its customers, adding to production costs and delivery times.

Another connector device that has been devised includes a cable suspended bracket formed in two halves for clamping the end of the fixture, with the bracket being opened by moving the upper half of the bracket upwardly on the hanger cable. While this latter design provides for somewhat easier installation, it has the particular disadvantage of preventing the brackets from being suspended close to the ceiling due to the need to move the upper half of the bracket upwardly on the hanger wire in order to allow proper removal and insertion of the fixture.

The present invention is intended to greatly simplify the installation process for linear lighting fixtures and to provide for a modular articulated linear lighting system that can readily be modified, added to or customized to meet particular and changing lighting needs. Typically, once in place, a lighting system comprised of an array of individual linear lighting elements cannot be changed without substantial reinstallation work. For example, it may be desirable to exchange a faulty fixture element altogether, or to change the lighting fixtures from direct fixtures to indirect fixtures, or vice versa, or to change lenses on a fixture to modify light distribution patterns, or to actually reposition fixtures. It may also be desirable to add to a fixture array already in place, for example, to provide additional task lighting to a series of new work stations in a computerized office.

The present invention provides lighting fixture hanger units for use with an array of linear lighting elements or modules wherein the fixture modules can easily be inserted in or removed from the array by means of a quick release removal operation, or wherein the fixtures can easily be rotated within the hanger units to change between up, down or side lighting. The hanger unit of the invention at the same time blends with the external appearance of the lighting modules used such that the lighting system looks to be a continuous, aesthetically pleasing structure uninterrupted by obtrusive hanger hardware. If an articulated look is to be emphasized the hanger units can be given a color different from the fixture modules. Importantly, fixture modules used with the invention can be standardized in terms of connecting hardware which will fit all varieties of hanger units.

SUMMARY OF THE INVENTION

The lighting fixture hanger unit of the present invention is comprised of a housing that includes at least one fixture connection port. The fixture connection port in turn includes a flange structure adapted to clamp over and secure a suitable male connector on the end of a linear lighting fixture element that is so adapted for use with the hanger unit. The flange structure extends about the perimeter of the fixture connection port and is formed, in part, by a bottom hinge bracket pivotally attached to a hinge point in the housing which can be pivoted downwardly to release and engage any standardized fixture end connector. Latch means within and accessible from the bottom of the housing are provided for releasably locking the free end of the bottom hinge bracket in a closed position.

In the preferred embodiment of the invention a removable bottom cover piece engages the bottom of the hanger unit housing to cover the bottom hinge bracket when the bottom hinge bracket is closed. The bottom cover hides the bottom hinge bracket and other internal parts of the hanger unit from view and is formed to blend the external shape of the bottom of the hanger unit with the external shape of the top of the unit. Preferably, the unit's external shape will be chosen to compliment the external shape of the lighting fixture or fixtures to be secured by the unit, though the hanger unit and fixture need not be the same shape. While the hanger unit of the present invention is shown herein as engaging cylindrical (round) fixture elements, it is understood that the hanger unit of the invention might engage other shaped fixtures as well, for example, oval, square, or multisided fixtures.

In one illustrated embodiment the hanger unit is provided with two opposed fixture connection ports and two corresponding bottom hinge brackets for joining two lighting fixture elements end to end; multiple units of this design can join multiple fixture elements in a run of fixtures. It will readily be appreciated that other configurations of the basic hanger unit can be provided with two or more ports for connecting and supporting lighting fixture elements at different connecting angles. One example of an alternative design is shown in FIGS. 7–9 which illustrate a cube hanger wherein up to four lighting fixture elements can be connected at 90° angles to each other. Other designs might include a Tee configuration having three connection ports (and hinge brackets), an elbow having two connection ports, or a cross design having four connection ports at angles other than 90°. Unused connection ports can be capped with a suitable removable insert plate that blends the exterior hanger unit surfaces. The hanger units are very versitile in that any number of their connection ports can be used according to the lighting system's requirements without affecting the aesthetics of the hanger.

Therefore, it can be seen that an important object of the present invention is to provide a lighting fixture hanger unit which permits a lighting system comprised of an array of linear lighting modules to be easily installed and which also permits the individual lighting modules to be readily added to and subtracted from the system, or to be rotated, exchanged, or modified in order to change the light distribution characteristics of individual modules. Fixture modules can be removed from the hanger units almost with the ease of relamping the fixtures. This means the fixture modules can be moved between rooms or buildings or to any new location desired by the owner, and taken from old systems and put in new systems.

It is also an important object of the invention to provide a lighting fixture hanger unit which, in addition to achieving the above-stated objects, physically blends in with and compliments the exterior lines of the connected fixture elements. Other objects of the invention will be readily apparent from the following description of the illustrated embodiment and the accompanying drawings which are as follows:

DESCRIPTION OF THE PREFERRED EMBODIMENT

Figure 2:
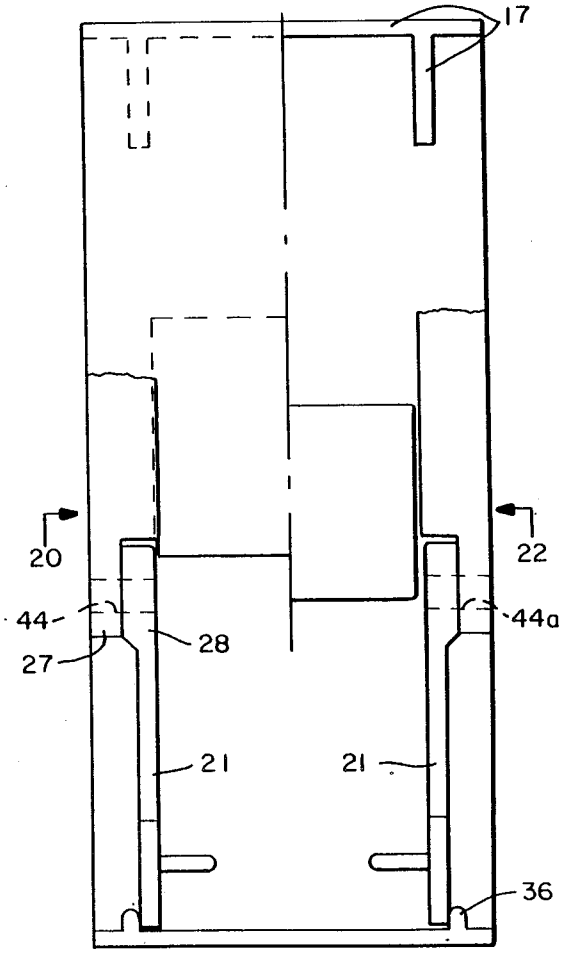
FIG. 2 is a partial cut away, side elevational view thereof, in partial section.

Reference is now made to the drawings and particularly to FIGS. 1–4 which illustrate a two port fixture hanger unit 11 which can join two cylindrically shaped linear fixture elements end to end. The hanger unit includes a top housing 17, which has a cylindrical exterior surface 18 generally conforming in size to the shown cylindrical linear lighting element 15 connected thereto, and a bottom portion 16 which is generally open and accessible when the bottom cover piece 31 (hereinafter described) is removed. It is contemplated that the illustrated hanger unit would be provided in different diameters for use with different standard diameter fixture elements, such as 4, 6 and 9 inch diameters.

Figure 3:
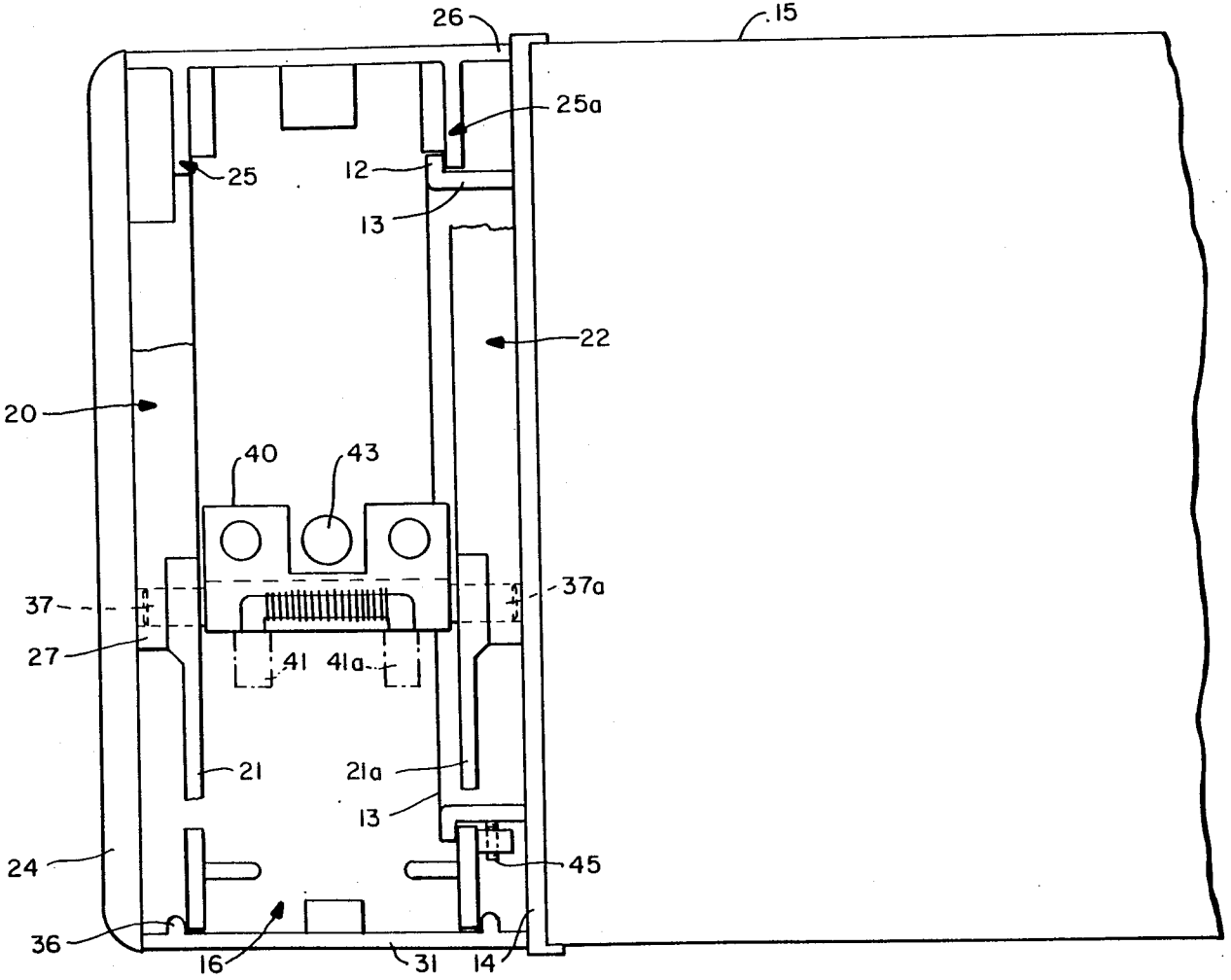
FIG. 3 is a side elevational view thereof, in partial section, showing engagement to a cylindrical fixture element.
Figure 4:
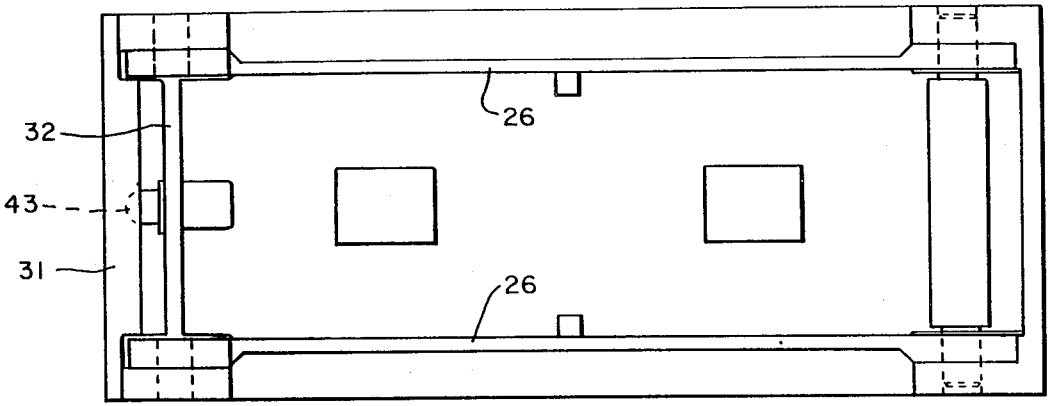
FIG. 4 is a bottom plan view thereof.
Figure 5:
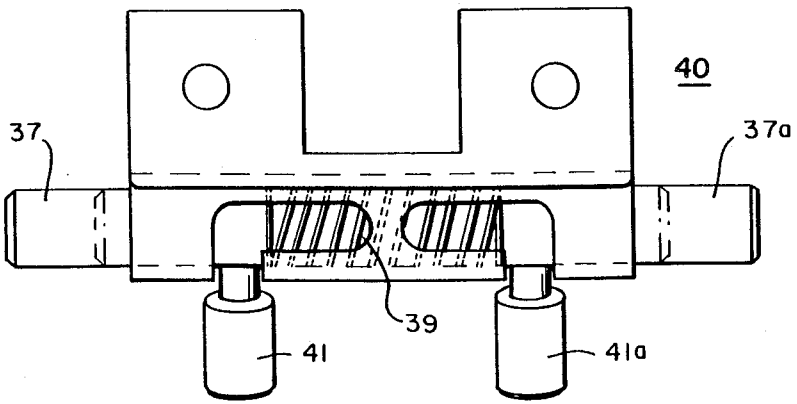
FIG. 5 is a side elevational view of the latch mechanism for the hinge brackets of the embodiment illustrated in the foregoing figures.

The top housing of the FIGS. 1–4 embodiment in part forms two opposed fixture connection ports 20, 22 to which two separate fixtures can be connected as hereinafter described. Referring to FIG. 3, a cylindrical linear fixture 15 having a male end connector, such as the illustrated flanged connector ring 13 projecting from the fixture's end plate 14, is shown connected via its end connector to the fixture's right hand hanger port 22, while the left hand port 20 is capped with a flat circular removable insert plate 24. By capping one port of the hanger unit the unit can be used as an end hanger for a single fixture or line of fixtures. The insert plate can later be removed if it is desired to add an additional fixtures.

Figure 1:
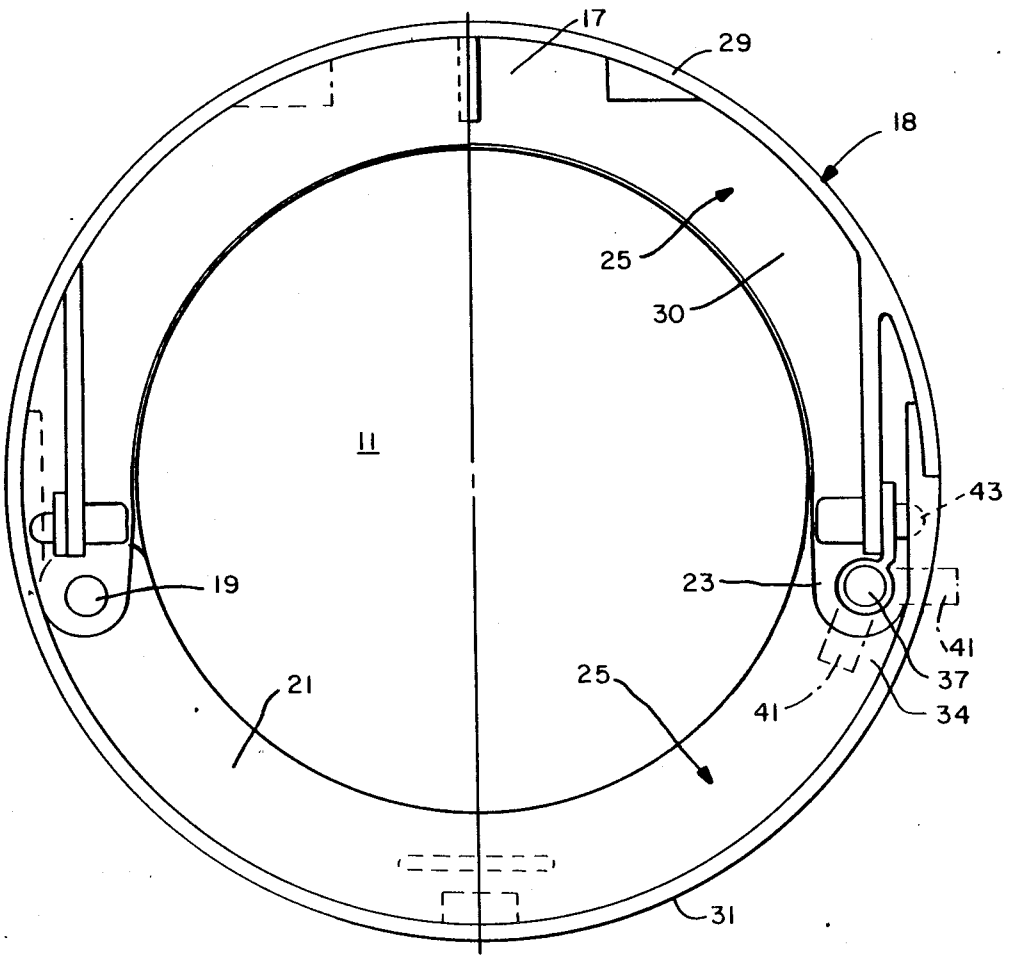
FIG. 1 is a partial cut away, front elevational view of a two port, hanger unit in accordance with the present invention.

Each of the connection ports, for example left hand port 20, includes a radially inwardly extending circular flange structure 25 disposed around the perimeter of the port inside of the top housing and set back from the rim 26 of the housing outer cylinder wall 29. As best seen in FIG. 1, the circular flange structure is formed, in part, by an upper flange portion 30 which is integral to the top housing and, in part, by a bottom hinge bracket 21 which is pivotally attached to a hinge point 19 within the hanger unit just beneath the top housing. The hinge point is located at one end of the upper flange portion while the free end 34 of the hinge bracket is secured to the opposite end of this upper flange. (The drawings show a left hand hinge, however, a right hand hinge could be used as well.) The hinge bracket and upper flange have interlocking ends 27, 28 which overlap in the plane of the flange when, as shown in FIG. 3, the bottom hinge bracket is in a pivotally closed position.

Figure 6:
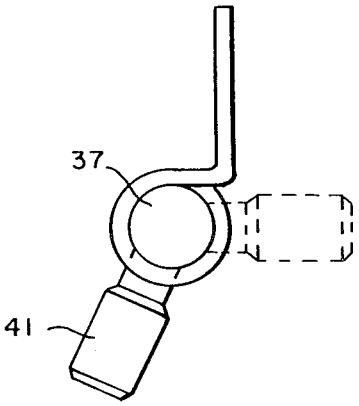
FIG. 6 is an end elevational view thereof.

Means for locking the hinge bracket's free end 34 in its closed position is provided in the form of a dual, spring loaded latch mechanism 40 secured to the housing's inside wall between the two flange structures **25, 25*a* associated with the left and right hand fixture connection ports 20, 22. The dual latch mechanism, which locks both of the left and right hand hinge brackets 21, 21*a*, includes opposed locking pins 37, 37*a* extending into pin receiving holes 44, 44*a* bored through the interlocking ends 27, 28 of the upper flange and hinge bracket for each of the respective flange structures. Two latch releases in the form of toggles 41, 41*a*, one for each of the two locking pins, are spring loaded with a compression spring 39 and extend generally downwardly from the latch mechanism between the two hinge brackets 21, 21*a* so as to be accessible by hand through the bottom portion 16 of the hanger unit. As shown in FIG. 3, by moving either of the toggles inwardly toward the other toggle, the toggle's corresponding locking pin 37, 37*a* can be retracted against a spring restoring force to release the hinge brackets. Also, FIGS. 1 and 6** illustrate, by means of dashed lines, how the toggles can be rotated upwardly to increase accessibility and facilitate gripping.

It is understood that the hinge point 19 might also be provided by a latch mechanism which permits pivoting of the hinge bracket on the latch pin. Thus, both right and left hinges could be provided within the same unit.

As above-mentioned, the external shape of the top housing is chosen to compliment the external shape of the linear fixtures to be connected to the unit, and the illustrated cylindrical housing shape suits this purpose well. The invention, however, is not so limited and other shapes might include oval, square, or multisided housings to, if desired, correspond in shape to similarly shaped linear fixtures. Whatever the shape, the open bottom portion of the hanger unit is covered by a cover piece that can be removed for accessing the bottom hinge brackets supported beneath the housing. Referring to the FIGS. 1–4 embodiment, a semicylindrical cover piece 31 having substantially the same width as the top housing removably fits over the hanger's bottom portion 16 so as to close the cylindrical shape of the housing and conceal the hinge brackets. Laterally disposed spring loaded detent pins 43 mounted to a cross-rib support 32 within the housing engage corresponding detents in the interior wall of the cover to hold the cover in place; additional circumferential guide ribs 36 formed on the cover's interior wall are spaced to interlock the bottom hinge brackets to provide added lateral rigidity to the structure. Other mechanical means for holding the bottom cover piece in place might include spring clips placed on the bottom of the cover piece to engage the bottom of the hinge brackets.

To use the hanger unit shown in FIGS. 1–4, two or more hanger units are first mounted or suspended throughout a space, such as an open office, in accordance with a prescribed lighting fixture array design. (Other shaped hanger units may also be used in this array.) The hanger units can be suspended from a ceiling by air craft cable or stems, or the hanger units can be wall or ceiling mounted, whatever the lighting designer specifies. Linear lighting fixture elements manufactured to standard lengths and having flanged connector rings 13 projecting from their two end plates can then be installed as follows: With the bottom cover pieces 31 removed, the interior hinge brackets of two units between which a fixture element is to be connected are released by retracting the appropriate toggles of the units latch mechanisms. The hinge brackets will hinge downwardly thereby opening the flange structure and permitting the flanged connector rings 13 at the ends of the fixture element 15 to be installed up against the upper flange portion 30 of the hanger unit's internal flange structure 25. When each end of the fixture is in place in its respective hanger unit, then the hinge brackets 21 can be hinged closed over the fixture connector rings 13 while holding in the latch mechanism toggles 41; the toggles are then released to lock the hinge brackets closed. To prevent the fixture from rotating in the connection port of the hanger unit, a suitable accessible set screw or the like can be provided, such as the set screw 45 shown in FIG. 3 to be attached to the hinge bracket 21*a*. Once in place, and with the bottom cover pieces off, the fixture or fixtures can be electrically connected to wiring (not shown) in the hanger housing by using, for example, commercially advailable modular plastic snap fit electrical connectors. Finally, the bottom cover pieces 31 are replaced to complete the installation. It is seen that so installed the internal flange structure of the suspension unit clamps over the fixture's connector rings and locks the connector rings due to the flanged ends 12 thereof being of a larger diameter than the closed flange structure 25.

Figure 7:
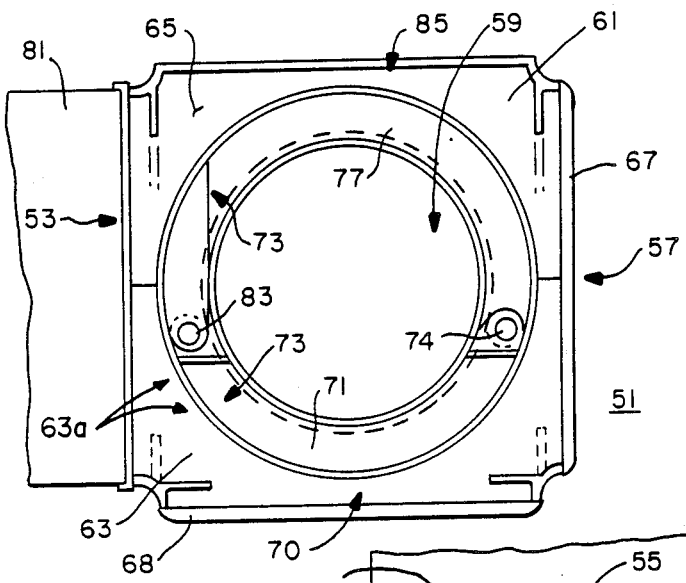
FIG. 7 is a front elevational view of an alternative cube shaped embodiment of the lighting fixture hanger unit of the present invention.
Figure 8:
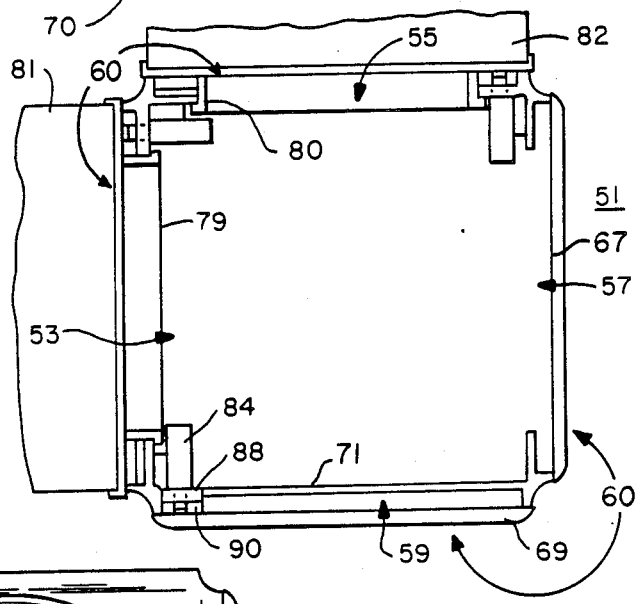
FIG. 8 is a top plan view thereof, omitting the detail of the latch pull and hinge bracket for port 57.
Figure 9:
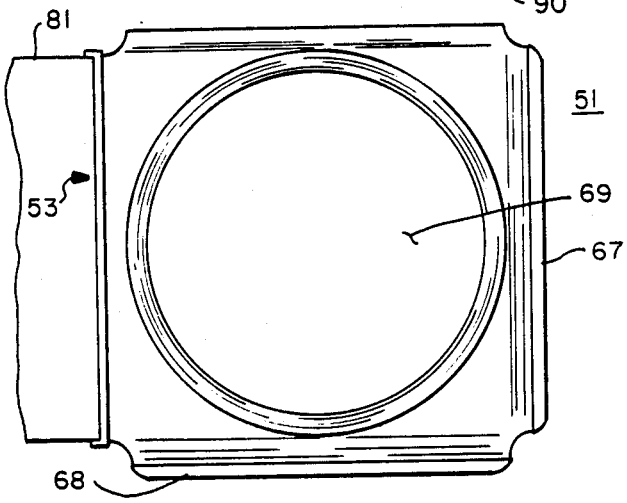
FIG. 9 is a side elevational view thereof as seen from the right side and showing a fixture connection port cover plate.

FIGS. 7 and 8 of the drawings illustrate an alternative embodiment of the basic hanger unit design. In this embodiment, a cube shaped hanger unit, generally denoted by the numeral 51, has up to four fixture connection ports 53, 55, 57, 59, each 90° apart, on the four perimeter sides 61 of a cube shaped hanger. The four ports are formed within the cube formed by the top housing 61 (the upper half of the cube) and bottom cover piece 63 (the lower half of the cube) which covers the bottom portion 63*a* of the hanger. Removable insert plates, such as plates 67, 69, can be used to cover unused ports, that is ports to which no lighting fixture is connected. The insert plates provide a circularly shaped side surface that blends in with the overall cube design. It is noted that a removable bottom insert in the bottom cover piece 63. The bottom part 70 can be used to install a Reference is now primarily made to the structure of the fixture connection port 59 illustrated in FIG. 7. Internally of each port of the cube 51, such as port 59, there is a bottom hinge bracket 71 that forms part of the port's fixture engaging flange structure 73. The hinge brackets, each of which is pivotally attached to its own hinge point within the housing (e.g. hinge point 74 seen in FIG. 7), are 90° apart and rotate downwardly with respect to the cube housing in vertical planes that are perpendicular to one another. The inwardly projecting flange structure at each port is also formed in part by the upper flange portion 77 that is integral to the housing. Referring to FIG. 8 the flange structure of ports 53 and 55 are shown to be releasably clamped over the corresponding flanged connector rings 79, 80 of the two shown linear lighting fixture elements 81, 82. Each hinge bracket of the cube is secured in its closed position to one end of the upper flange 77, which is the end opposite the hinge point 74. Securement of the hinge bracket is achieved by means of a latch mechanism 83 having a spring loaded latch pull 84 located in the corner of the cube. Thus, it can be seen that, if a hinge bracket is provided at four sides of the cube, there will be four latches, one located in each of the cube's side corners. Again with reference to connection port 59, the latch pin of each latch will engage the interlocking ends 88, 90 of the port's upper flange 77 and bottom hinge bracket 71. As in the earlier described embodiment, the latch pulls are disposed to be generally accessible from the bottom of the cube when the bottom cover piece 63 is removed.

In use, the cube version of the hanger unit 51 can be used as an aesthetically pleasing corner hanger for joining two, three or four laterally extending lighting fixture elements, such as the right angle fixture elements illustrated in FIG. 7. It might also be used to connect a parallel run of fixtures such that perpendicular fixtures between parallel runs can later be added. The cube can be suspended from the ceiling, such as by aircraft cable and a hanger bracket that slips within the top opening 85 of the cube or by other methods, such as stem or bracket mounting. Or by removing the bottom cover plate 68 the cube can be supported on a vertical support member. However suspended or supported, fixture elements can be readily installed, exchanged, or rotated within any of the lateral ports of the cube by first removing the bottom cover piece 63 and then releasing and lowering the appropriate hinge bracket within the cube.

It can readily be appreciated from the above description that hanger units having other shapes, for example an elbow shape, a Tee shape, or an "X" shape can be provided with a hinge bracket construction similar to that above described wherein the ends of one or more linear lighting fixtures can be releasibly connected into a articulated array of fixtures.

Therefore, the present invention generally provides for a lighting fixture hanger unit that greatly facilitates installation and exchange of linear lighting fixtures and reduces the cost of the producing standard fixture modules by eliminating the need to fabricate fixture housings that must be attached to a variety of possible types of hanger hardware. Using the hanger units of the present invention linear lighting fixtures can readily be arrayed in an overall lighting system which can thereafter be modified or added to in order to meet changing lighting requirements. Although the invention has been described in considerable detail in the foregoing specification, it is not intended that the invention be limited to such detail, except as necessitated by the following claims.

What we claim is:

1. A lighting fixture hanger unit having at least one port for hanging a linear lighting fixture which has at least one end plate and a flanged connector ring projecting outwardly from said end plate, said hanger fixture unit comprising a top housing having an exterior surface, a bottom portion, and at least one fixture connection port formed in part by said top housing in at least one side of said hanger unit, said port presenting a shaped perimeter for meeting with the end of a correspondingly shaped linear lighting fixture, said fixture connection port including a radially inwardly extending flange structure recessed within the opening of said port for lockingly engaging a flanged connector ring of a linear lighting fixture, said flange structure being formed in part by a bottom hinge bracket pivotally attached to a hinge point within said hanger unit such that the hinge bracket can be pivoted downward from a closed end connector engagement position to an open position for receiving a flanged connector ring projecting from an end plate of a linear lighting fixture, said bottom hinge bracket forming at least in part the structure of the bottom portion of said hanger unit, and means within said hanger unit and accessible through the bottom portion thereof for releasably locking said bottom hinge bracket in its closed end connector engagement position.

2. The lighting fixture hanger unit of claim 1 wherein said housing includes a removable cover piece for covering the bottom portion of said housing.

3. The lighting fixture hanger unit of claim 2 wherein said removable cover piece is formed to compliment the external shape of said housing.

4. The lighting fixture hanger unit of claim 3 wherein said housing with said cover piece in place has a external cylindrical shape.

5. The lighting fixture hanger unit of claim 1 wherein said housing has two fixture connection ports, each including a bottom hinge bracket.

6. The lighting fixture hanger unit of claim 1 wherein said means for releasably locking said hinge bracket includes a latch means mounted inside said hanger unit, said latch means including a spring loaded latch release accessible by hand through the bottom portion of said housing.

7. A generally cubed shaped lighting fixture hanger unit having at least one port for hanging a linear lighting fixture which has at least one end plate and a flanged connector ring projecting outwardly from said end plate, said hanger unit comprising a top housing having an exterior surface generally shaped as the upper halve of a cube, a bottom portion, four perimeter sides, and at least one fixture connection port formed in part by said top housing and located in one of said perimeter sides of said hanger unit, said fixture connection port presenting a shaped port perimeter for meeting with the end of a correspondingly shaped linear lighting fixture, and said fixture connection port further including a radially inwardly extending flange structure recessed within the opening of said port for lockingly engaging a flanged connector ring of a linear lighting fixture, said flange structure being formed in part by a bottom hinge bracket pivotally attached to a hinge point within said hanger unit such that the hinge bracket can be pivoted downward from a closed end connector engagement position to an open position for receiving a flanged connector ring projecting from an end plate of a linear lighting fixture, said bottom hinge bracket defining at least in part the structure of the bottom portion of said hanger unit, and means accessible by hand for releasably locking said bottom hinge bracket in its closed end connector engagement position.

8. The lighting fixture hanger unit of claim 7 wherein said cube shaped hanger has four fixture connection ports and associated hinge brackets, one at each perimeter side thereof.

9. The lighting fixture hanger unit of claim 8 wherein said locking means includes a spring loaded latch release associated with each of said bottom hinge brackets.

10. The lighting fixture hanger unit of claim 7 wherein said hanger unit includes a removeable bottom cover piece for covering the bottom portion of said hanger, said cover piece substantially forming the bottom half of a cube which, when in place, completes the cube shape of said hanger.

11. The lighting fixture hanger unit of claim 10 including removeable insert plates for covering any unused fixture connection ports on the perimeter sides of said housing, said insert plates, when in place, substantially forming perimeter sides of the housing's cube shape.

12. The lighting fixture hanger unti of claim 11 wherein said bottom cover piece includes a bottom port and a removeable insert plate for covering said bottom port.

13. A generally cubed shaped lighting fixture hanger unit having multiple ports for hanging a linear lighting fixture which has at least one end plate and a flanged connector ring projecting outwardly from said end plate, said hanger unit comprising a top housing having an exterior surface generally shaped as the upper halve of a cube, a bottom portion, four perimeter sides, and four fixture connection ports formed in part by said top housing, one fixture connection port being formed in each of the perimeter sides of said hanger unit, each of said fixture connection ports presenting a shaped port perimeter for meeting with the end of a correspondingly shaped linear lighting fixture, and each of said fixture connection ports further including a radially inwardly extending flange structure recessed within the opening of said port for lockingly engaging a corresponding male end connector of a linear lighting fixture, said flange structure being formed in part by a bottom hinge bracket pivotally attached to a hinge point within said hanger unit such that the hinge bracket can be pivoted downward from a closed end connector engagement position to an open position for receiving a flanged connector ring projecting from an end plate of a linear lighting fixture, said bottom hinge bracket defining at least in part the structure of the bottom portion of said hanger unit, means accessible by hand for releasably locking said bottom hinge bracket in its closed end connector engagement position, and a removable bottom cover piece for covering the bottom portion of said hanger, said cover piece substantially forming the bottom half of a cube which, when in place, completes the cube shape of said hanger.

14. The lighting fixture hanger unit of claim 13 wherein said bottom cover piece includes a bottom port and a removable insert plate for covering said bottom port.

* * * * *

UNITED STATES PATENT AND TRADEMARK OFFICE

CERTIFICATE OF CORRECTION

PATENT NO. : 4,706,170

DATED : November 10, 1987

INVENTOR(S) : Douglas J. Herst and Henry H. Iwahashi

It is certified that error appears in the above—identified patent and that said Letters Patent is hereby corrected as shown below:

IN THE SPECIFICATION:

Col. 1, line 15, "crossectional" should be --cross-sectional--.

line 44, "hardward" should be --hardware--.

line 47, "accomodate" should be --accommodate--.

Col. 3, line 13, "versitile" should be --versatile--.

Col. 4, line 21, delete "an".

Col. 5, line 59, "advailable" should be --available--.

Col. 6, line 14, "part" should be --port--.

line 15, after "a" insert omitted words --bottom tubular support piece (not shown).--

Col. 7, line 2, "releasibly" should be --releasably--.

UNITED STATES PATENT AND TRADEMARK OFFICE

CERTIFICATE OF CORRECTION

PATENT NO. : 4,706,170

DATED : November 10, 1987

INVENTOR(S) : Douglas J. Herst and Henry H. Iwahashi

It is certified that error appears in the above-identified patent and that said Letters Patent is hereby corrected as shown below:

Title page:

IN THE ABSTRACT:

Line 10, "releasibly" should be --releasably--.

Signed and Sealed this

Seventeenth Day of May, 1988

*Attest:*

DONALD J. QUIGG

*Attesting Officer*

*Commissioner of Patents and Trademarks*